US009845585B2

(12) United States Patent
Chilson

(10) Patent No.: US 9,845,585 B2
(45) Date of Patent: Dec. 19, 2017

(54) GROUND ANCHORING SUPPORT APPARATUS

(71) Applicant: Keith Chilson, Olivehurst, CA (US)

(72) Inventor: Keith Chilson, Olivehurst, CA (US)

( * ) Notice: Subject to any disclaimer, the term of this patent is extended or adjusted under 35 U.S.C. 154(b) by 0 days.

(21) Appl. No.: 14/863,670

(22) Filed: Sep. 24, 2015

(65) Prior Publication Data

US 2017/0089025 A1 Mar. 30, 2017

(51) Int. Cl.
*E02D 5/80* (2006.01)

(52) U.S. Cl.
CPC ..... *E02D 5/803* (2013.01)

(58) Field of Classification Search
CPC ..... E02D 5/803; E02D 5/80
See application file for complete search history.

(56) References Cited

U.S. PATENT DOCUMENTS 768,705 A 8/1904 Swan
1,564,069 A 12/1925 Hoovens
3,295,274 A 1/1967 Fulton
3,655,160 A 4/1972 Grillot
3,840,203 A 10/1974 Sheehy
3,949,527 A * 4/1976 Double ..... B65D 90/00 150/154
4,044,513 A * 8/1977 Deike ..... E02D 5/803 405/259.5
4,084,812 A * 4/1978 Melrose ..... A63B 9/00 273/348
4,309,911 A * 1/1982 McCall ..... G01L 5/0033 73/862.53
4,802,317 A 2/1989 Chandler
5,791,090 A * 8/1998 Gitlin ..... E04H 9/14 52/23
5,819,477 A * 10/1998 Gaffney ..... E04H 9/14 135/115
6,389,743 B1 5/2002 Stephenson
7,611,129 B1 * 11/2009 Stahm ..... E02D 5/803 254/243
7,862,259 B2 * 1/2011 Carpenter ..... E02D 5/74 405/259.1
8,011,860 B2 9/2011 Stahm
8,424,549 B1 * 4/2013 Goldsmith ..... E04H 15/60 135/116
8,864,424 B2 10/2014 Jones et al.
2012/0017960 A1 * 1/2012 Doell ..... E04H 12/2246 135/120.1

* cited by examiner

*Primary Examiner* — Elizabeth A Quast
(74) *Attorney, Agent, or Firm* — PatentFile, LLC; Bradley C. Fach; Steven R. Kick

(57) ABSTRACT

A ground anchoring support apparatus for securing and supporting an object to the ground which may comprise a tensioning element which may include a lead with a tensioning fastener coupled to a first end of the lead and a ground anchor coupled to a second end of the lead. The tensioning fastener may also be coupled to the object. The apparatus may also comprise a ground support element which may include a base and a cavity, and in which a portion of the object may be received within the cavity. The ground anchor may be inserted into the ground and the first end of the lead may be tensioned against the second end of the lead by tensioning the tensioning fastener. In this manner, the ground anchor and tensioning fastener may be drawn or tensioned together to secure the object to the ground support element and also to the ground.

18 Claims, 7 Drawing Sheets

GROUND ANCHORING SUPPORT APPARATUS

FIELD OF THE INVENTION

This patent specification relates to the field of anchoring devices for securing an object to the ground. More specifically, this patent specification relates to an apparatus for supporting and anchoring an object securely to a plurality of ground surfaces.

BACKGROUND

Various products have been developed for securing objects to the ground. These products seek to secure objects, such as posts, poles, pipes, conduits, and the like, to a supporting ground surface. Some products incorporate a skewer which is inserted into a ground surface and which is coupled to the object. When pressure is continually cycled on and off the object, over time the object and skewer become loose and less secure. Additionally, the object may eventually sink into the ground surface which may also decrease the stability of the object. Other methods to secure or support an object include the use of support pads which may be dug into the ground and then filled with concrete. However, not only are these methods expensive labor intensive, but they are difficult to remove should the need or positioning of the object change.

Therefore, a need exists for novel apparatuses which are able to anchor and support an object, such as a post, pole, pipe, conduit, and the like to a ground surface. There also exists a need for novel ground anchoring support apparatuses which are able to secure an object to the ground even when the object is subjected to continual on and off pressure cycles. There is a further need for novel ground anchoring support apparatuses that are not expensive labor intensive to install. Finally, there exists a need for novel ground anchoring support apparatuses which may be removed or repositioned with less exertion than conventional anchoring devices.

BRIEF SUMMARY OF THE INVENTION

A ground anchoring support apparatus for securing and supporting an object to the ground is provided. In some embodiments, the ground anchoring support apparatus may comprise a tensioning element which may include a lead with a tensioning fastener coupled to a first end of the lead and a ground anchor coupled to a second end of the lead. The tensioning fastener may be coupled to the object. The apparatus may also comprise a ground support element which may include a base and a cavity, and in which a portion of the object may be received within the cavity. The ground anchor may be inserted into the ground and the first end of the lead may be tensioned against the second end of the lead by tensioning the tensioning fastener. In this manner, the ground anchor and tensioning fastener may be drawn or tensioned together to secure the object to the ground support element and also to the ground.

In further embodiments, a ground support element 12 may comprise a cavity and the object may be coupled to the ground support element by inserting a portion of the object within the cavity.

In still further embodiments, a ground anchor may comprise a penetration tip and a driving end. By inserting the penetration tip into the ground and pressing against the driving end, the ground anchor may be driven into the ground as the penetration tip travels through a desired amount or depth of ground. When the ground anchor is at the desired depth, tensioning the lead to produce an upward pull on the lead may rotate the ground anchor to a parallel position in which the penetration tip and the driving end are orientated generally parallel to the ground surface into which the ground anchor was driven thereby anchoring ground anchor in the ground.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
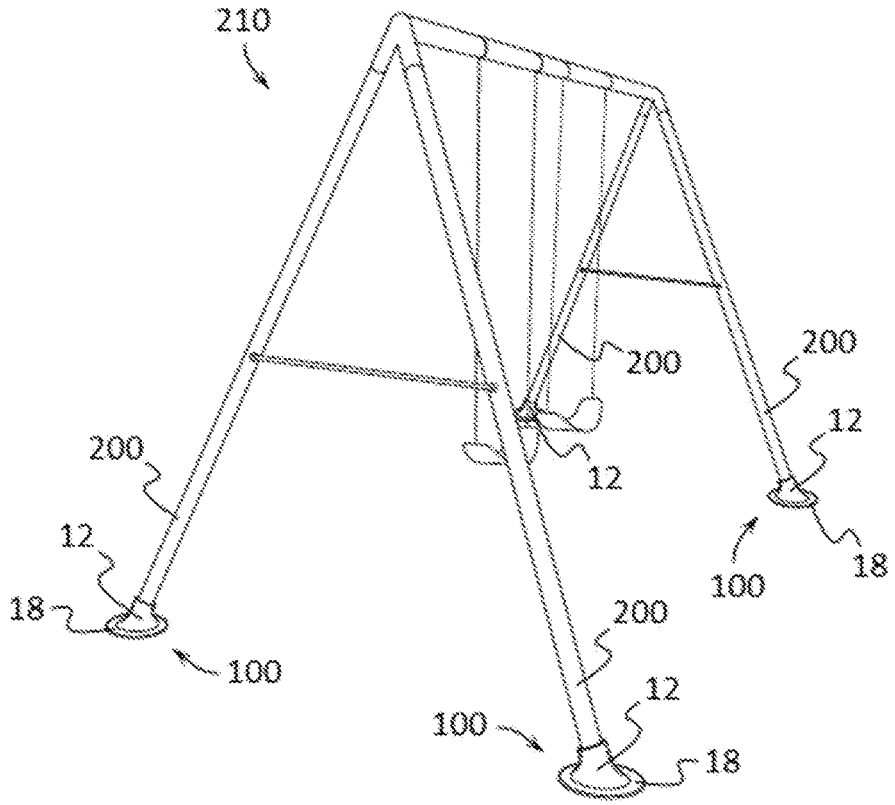
FIG. 1 depicts a perspective view of an example of four ground anchoring support apparatuses engaged to a swing set according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New ground anchoring support apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 2:
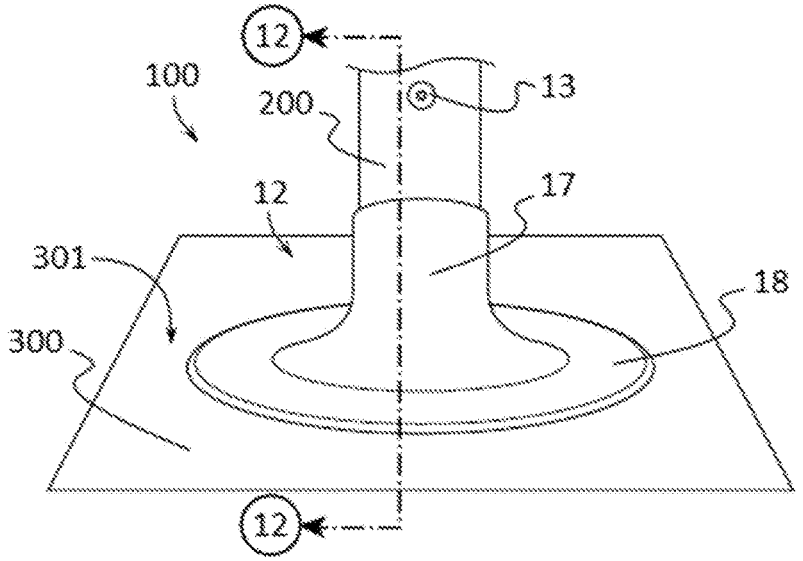
FIG. 2 illustrates a perspective view of an example of a ground anchoring support apparatus supporting an object on a ground surface according to various embodiments described herein.

The present invention will now be described by example and through referencing the appended figures representing preferred and alternative embodiments. Referring now to FIGS. 1 and 2, examples of ground anchoring support apparatuses 100 supporting an object 200 on a ground surface 301 are illustrated. In some embodiments, an object 200, which may be received by the apparatus 100, may comprise one or more cylindrical poles such as may be used to support a swing set 210. In this example, a portion of a pole object 200 may be inserted into the cavity 19 (FIGS. 3, 5, 6) of the ground support element 12. Also, a tensioning element 11 (FIGS. 3, 4, 12) may be coupled to the pole object 200 such as by coupling a tensioning fastener 13 to the pole object 200. Once received by the ground support element 12, the ground contact surface 28 (FIG. 6) of the skirt 18 may prevent the pole object 200 from sinking into the ground 300.

Figure 3:
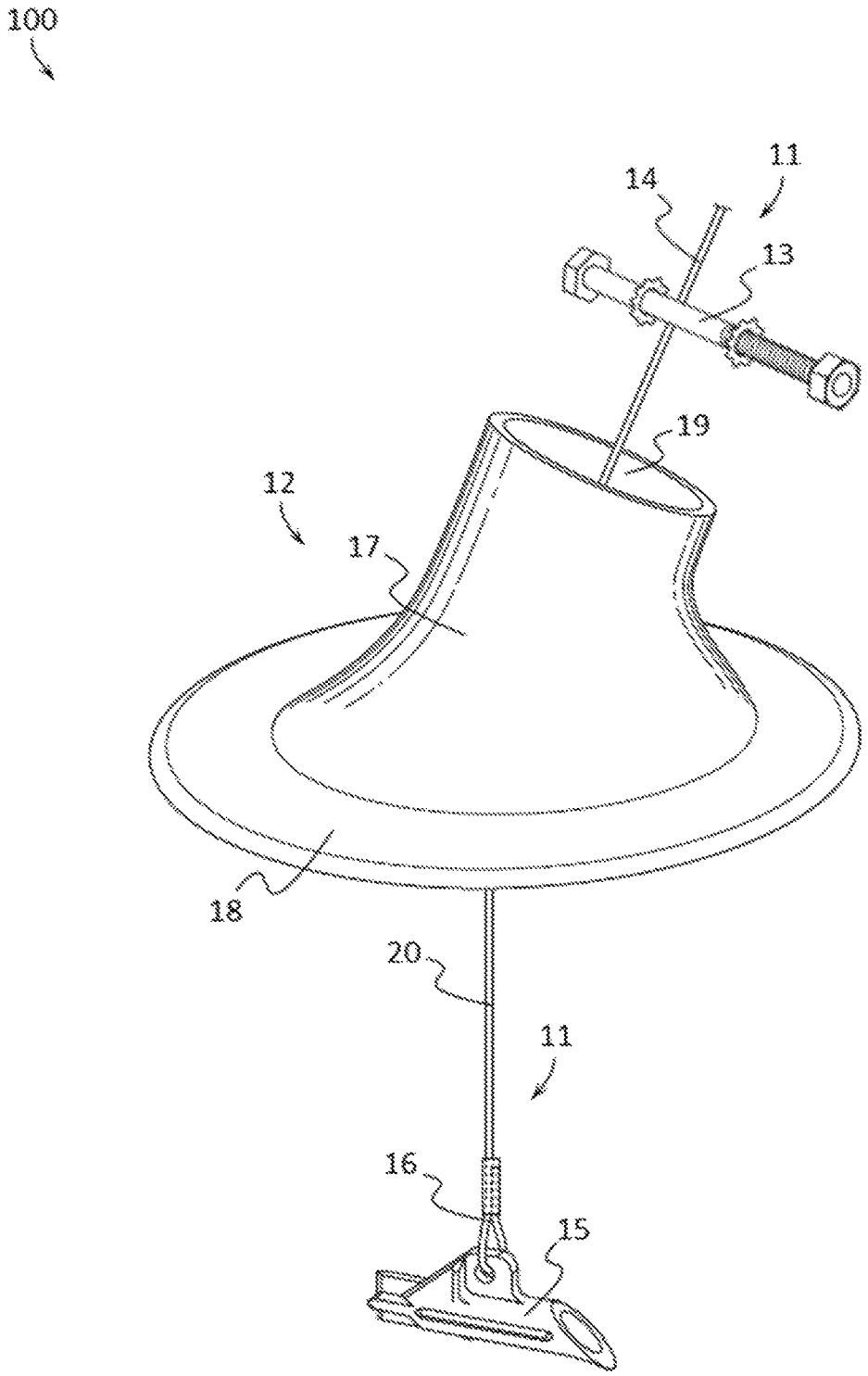
FIG. 3 shows a perspective view of an example of a ground anchoring support apparatus according to various embodiments described herein.

FIG. 3 shows a perspective view of an example of a ground anchoring support apparatus 100 according to various embodiments described herein. In this example, the apparatus 100 comprises a tensioning element 11 and a ground support element 12. The tensioning element 11 may be coupled to an object 200 (FIGS. 5-7), such as with a tensioning fastener 13, which may comprise a lead 20 at a first end 14 and may be coupled to a ground anchor 15 at a second end 16. The ground support element 12 may comprise a base 17 with a skirt 18. The ground support element 12 may also comprise a cavity 19 which may be coupled to a portion of the object 200, such as by receiving a portion of the object within a cavity 19. In some embodiments, the first end 14 of the tensioning element 11 and the ground support element 12 may be coupled to an object 200. The ground anchor 15 may be inserted into the ground and the first end 14 may be tensioned to the second end 16. Once tensioned, the apparatus 100 and object 200 may be anchored and supported by the ground which is between the ground anchor 15 and the skirt 18.

Figure 4:
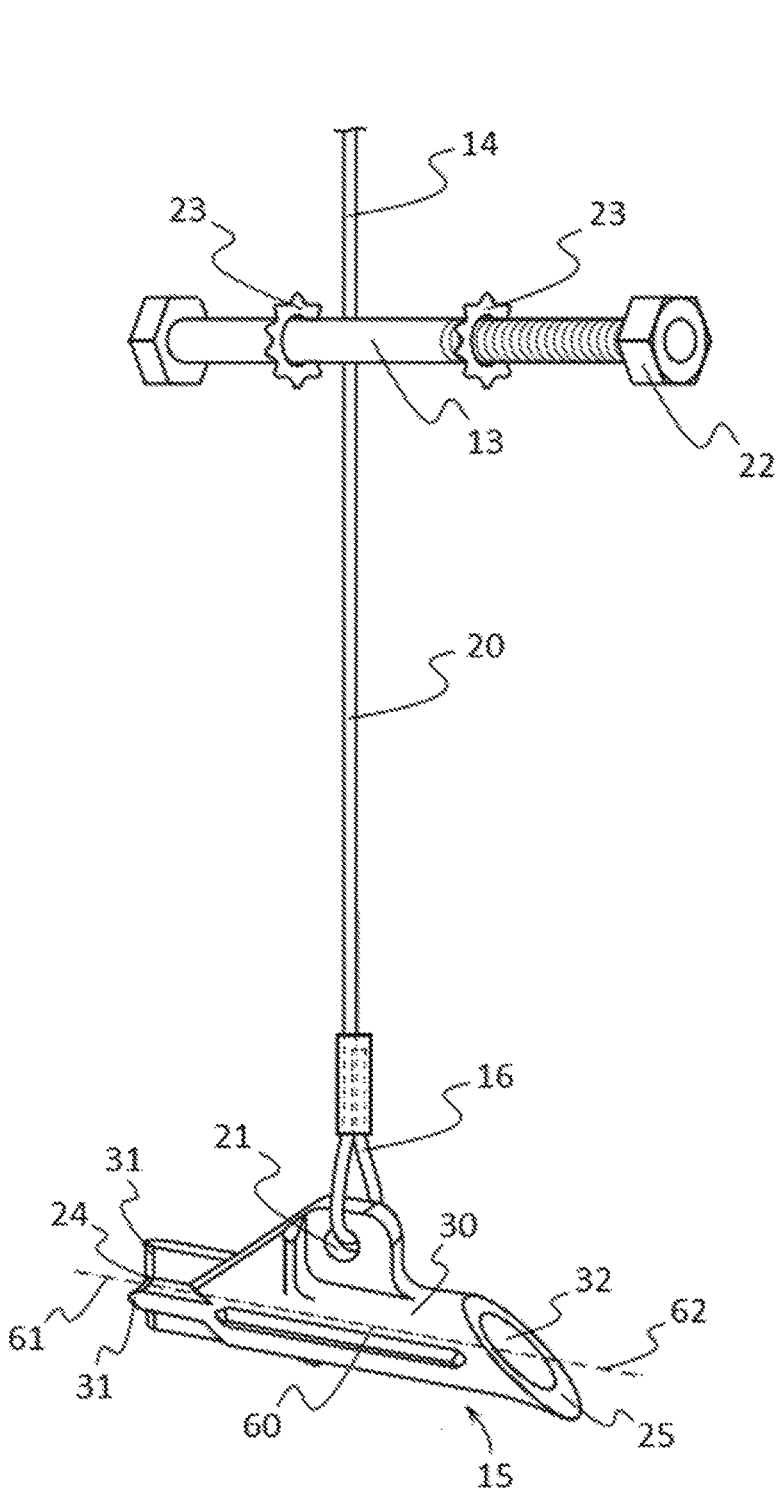
FIG. 4 depicts a perspective view of an example of a tensioning element according to various embodiments described herein.

FIG. 4 depicts a perspective view of an example of a tensioning element 11 according to various embodiments described herein. In some embodiments, a tensioning element 11 may comprise a ground anchor 15 which may be coupled to a tensioning fastener 13. In further embodiments, a tensioning element 11 may comprise a lead 20 which may couple the ground anchor 15 to a tensioning fastener 13. In some embodiments, a portion of the lead 20 such as a portion of the second end 16 may be received, such as through an anchor aperture 21 of the ground fastener 15, by the ground anchor 15 and then the second end 16 may be coupled or secured back onto itself to coupled the ground anchor 15 to the lead 20 thereby pivotally coupling the second end 16 of the lead 20 to the ground anchor 15. In further embodiments, the second end 16 may be coupled to the anchor aperture 21 with a fastener such as a bolt, rivet, and the like. The fastener may allow the ground anchor 15 to pivot relative to the lead 20, or the flexible material of the lead 20 may allow the ground anchor 15 to pivot relative to portions of the lead 20 such as the first end 14. A portion of the lead 20, such as a portion of the first end 14 may be coupled to a tensioning fastener 13, such as by inserting a portion of the first end 14 through an aperture of the tensioning fastener which may extend through or otherwise be coupled to the tensioning fastener 13. In other embodiments, a portion of the lead 20, such as a portion of the first end 14 may be coupled to a tensioning fastener 13, such as by bonding a portion of the first end 14 to the tensioning fastener 13.

A lead 20 may comprise a first end 14 and a second end 16. A tensioning fastener 13 may be coupled to a first end 14 and a ground anchor 15 may be coupled to a second end 16. In some embodiments, a lead 20 may comprise a length of flexible material which may be suitable for receiving and transferring tension between two objects such as between a ground anchor 15 and a tensioning fastener 13. In further embodiments, a lead 20 may be of any length and may comprise a flexible metal cable, a braided stainless steel cable, a cable made from other metals and metal alloys, vinyl-coated wire rope, galvanized vinyl-coated wire rope, any other wire rope, stainless steel straight link chain, galvanized proof coil chain, jack chain, or any other flexible material which may be suitable for receiving and transferring tension between two objects. In alternative embodiments, a lead 20 may comprise a generally inflexible material, such as an elongated threaded bolt, or other elongated textured object, and the optional texturing on the lead 20 may be configured to allow a tensioning fastener 13 to grip and draw the second end 16 of the lead 20 towards the tension fastener 13 by rotating or by otherwise tensioning the tension fastener 13.

In some embodiments, a tensioning fastener 13 may comprise a bolt, machine screw, or any other fastener. A tensioning fastener 13 may be rotationally coupled to an object 200 by inserting a portion of the tension fastener 13 through a portion of the object 200 such as through a bolt or screw hole in which the tensioning fastener 13 may rotate freely. A secondary fastener 22 may then be threaded onto and coupled to the tensioning fastener 13 to couple the tension fastener 13 through a portion of the object 200 while allowing the tension fastener 13 to rotate. In further embodiments, a secondary fastener 22 may be coupled to the tensioning fastener 13 and then tightened to squeeze the object against the tension fastener 13 so that friction between the secondary fastener 22, tensioning fastener 13, and the object 200 may prevent the tensioning fastener 13 from rotating thereby rotationally arresting the tensioning fastener 13 relative to object 200. In still further embodiments, one or more star washers 23 may also be received on the tensioning fastener 13. Optionally, one or more star washers 23, or other friction enhancing device, may be used to frictionally secure a portion of the tensioning fastener 13 and/or a portion of a secondary fastener 22 to the object 200 (FIGS. 5-7) which is to be secured by the apparatus 100 (FIGS. 1 and 7). A secondary fastener 22 and one or more star washers 23 may be coupled to the tensioning fastener 13 and then tightened to squeeze the object against the tension fastener 13 so that friction between the star washers 23, secondary fastener 22, tensioning fastener 13, and the object 200 may prevent the tensioning fastener 13 from rotating thereby rotationally arresting the tensioning fastener 13 relative to object 200.

As shown in FIG. 4, a ground anchor 15 may be generally elongated and comprise a penetration tip 24 and a driving end 25. In some embodiments, a ground anchor 15 may comprise an elongated body 30 with a longitudinal axis 60 and with a penetration tip 24 at a first end 61 of the longitudinal axis 60 and a driving end 25 at a second end 62 of the longitudinal axis 60. A ground anchor 15 may also comprise an anchor aperture 21 which may be coupled, such as pivotally coupled, to the body 30 and which also may be coupled to the second end 16 of the lead 20. In further embodiments, the anchor aperture 21 may be coupled to the body 30 at a position on the body generally equidistant to the penetration tip 24 and the driving end 25. For example, if the penetration tip 24 and the driving end 25 are separated by three inches on the body 30, the anchor aperture 21 may be coupled to the body 30 at a position on the body generally one and a half inches from the penetration tip 24 and generally one and a half inches from the driving end 25.

In some embodiments, the penetration tip 24 of the ground anchor 15 may be tapered to facilitate the movement of the ground anchor 15 through the ground 300. For example, the penetration tip 24 may be tapered by providing one or more edges 31 which may be pointed, angled, beveled, or the like to contact and ground as the ground anchor 15 moves through the ground 300 to displace the ground 300 around the body 30 and the lead 20. In further examples, the penetration tip 24 may be tapered by comprising a beveled edge 31 fashioned into a point or one or more rounded or pointed edges 31.

In some embodiments, the driving end 25 of the ground anchor 15 may comprise a driving cavity 32. A driving cavity 32 may be configured as a depression or recess on the driving end 25 which may be shaped to receive a portion of a linear driver 400. For example, a linear driver 400 may comprise a shaft, a portion of which may be received into the driving cavity 32, which may be hammered or otherwise driven in a linear fashion. In further embodiments, the ground anchor 15 may be driven into ground 300 by inserting the penetration tip 24 into ground and by driving a linear driver 400 into the driving cavity 32. By inserting the penetration tip 24 into the ground 300 (FIGS. 5 and 7) and pressing against or driving the driving end 25, the ground anchor 15 may be driven into the ground as the penetration tip 24 travels through a desired amount or depth of ground 300. Once the ground anchor 15 is at the desired depth, an upward pull on the lead 20 may rotate or pivot the ground anchor 15 to a parallel position in which the penetration tip 24 and the driving end 25 are orientated generally parallel to the ground surface 301 into which the ground anchor 15 was driven. In alternative embodiments, a ground anchor 15 may comprise an auger or any other ground anchor which may be driven into the ground 300 and which, once driven into the ground 300, may resist removal from the ground 300 to resist drawing the ground anchor 15 towards the tensioning fastener 13 when the lead 20 is tensioned.

Figure 5:
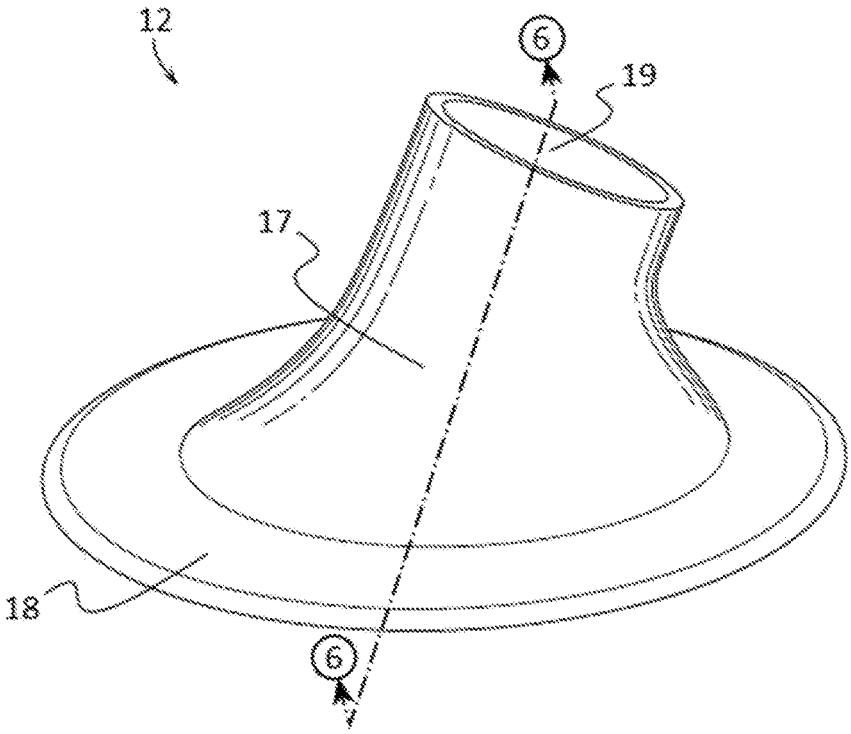
FIG. 5 illustrates a perspective view of an example of a ground support element according to various embodiments described herein.
Figure 6:
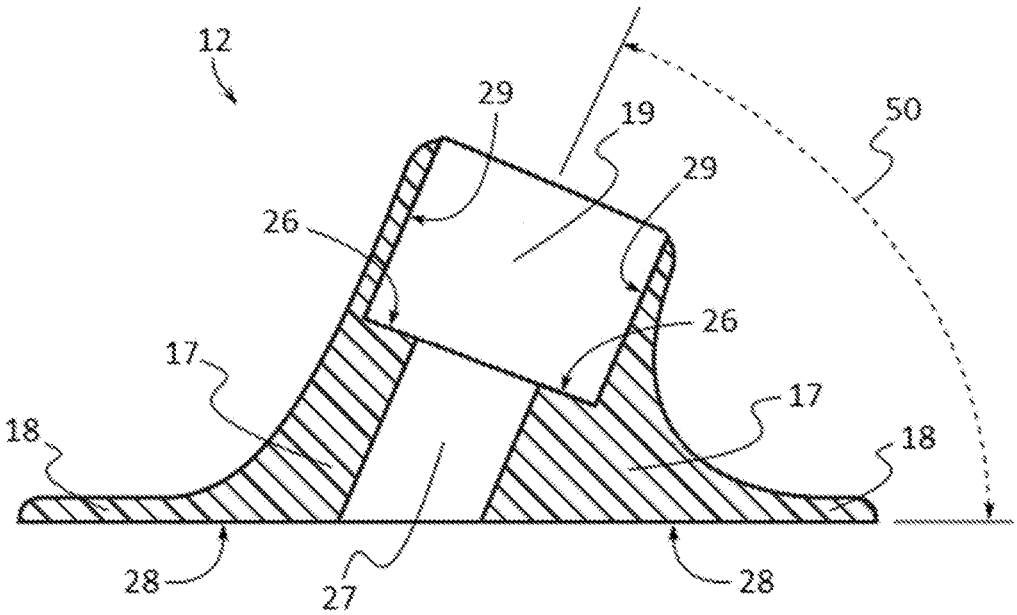
FIG. 6 shows a sectional, through line 6-6 shown in FIG. 5, elevation view of an example of a ground support element according to various embodiments described herein.
Figure 7:
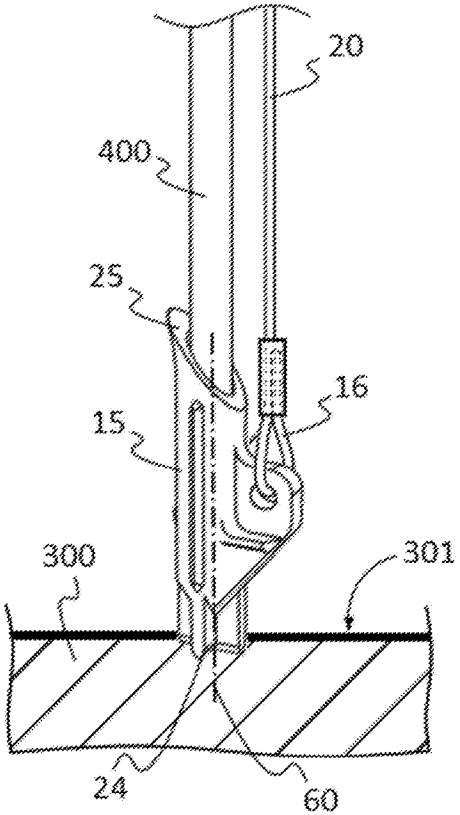
FIG. 7 depicts an elevation view of an example of a ground anchor being inserted into the ground according to various embodiments described herein.

FIGS. 5 and 6 show an example of a ground support element 12 according to various embodiments described herein. In some embodiments, a ground support element 12 may comprise a base 17 which may be coupled to a skirt 18. In further embodiments, a base 17 may be coupled to an object 200 (FIGS. 1, 2, 12), such as a post, pole, pipe, conduit, and the like, which is to be secured to a ground 300 surface 301. The skirt 18 may extend around the base 17 to enlarge the footprint of the ground support element 12 to prevent the ground support element 12 from sinking into the ground 300 (FIGS. 2, 7-12). In some embodiments, a skirt 18 may comprise a ground contact surface 28 which may enlarge the surface area of the ground support element 12 that may contact the surface 301 (FIGS. 2, 7-12) of the ground 300. Generally, the larger the surface area of the ground contact surface 28, the greater the resistance of the ground support element 12 to sinking into the ground that it may be supporting an object 200 over. For example, heavier objects and/or looser ground material may require a larger the surface area of the ground contact surface 28 to prevent the ground support element 12 to sinking into the ground that it may be supporting an object 200 over.

In some embodiments, the base 17 may include a cavity 19 which may be coupled to a portion of the object 200, such as by receiving a portion of the object 200 within a cavity 19. The cavity 19 may be generally complementarily shaped to the portion of the object 200 which is to be secured within the cavity 19. The cavity 19 may comprise an object support surface 26 which may be disposed within the cavity 19 and on which a portion of the object 200 may rest on when inserted into the cavity 19 to prevent the object 200 from passing through the ground support element 12. A cavity 19 may also comprise an object stabilizing surface 29 which may be disposed within the cavity 19 and which may contact a portion of one or more sides of an object 200 when a portion of the object is inserted into the cavity 19. By contacting a portion of the object 200, an object stabilizing surface 29 may stabilize and or frictionally secure the object 200 to the ground support element 12.

Optionally, the cavity 19 may be angled relative to ground contacting surface 28 to allow the ground support element 12 to support an object 200 at an angle relative to the ground 300 surface 301. In some embodiments, the cavity 19 may be disposed in the base 17 relative to ground contacting surface 28 with a cavity angle 50 that is between 10 and 90 degrees. For example and referencing the swing set of FIG. 1, the cavity 19 may be angled relative to ground contacting surface 28 with a cavity angle 50 that is approximately 45 degrees to receive and support an object 200 such as a swing set 210 support that is configured to contact the ground surface 301 at approximately 45 degrees.

In further embodiments, the cavity 19 and therefore a ground contact surface 28 and/or an object stabilizing surface 29 may be generally complementarily shaped frictionally secure a portion of the object 200 which is inserted within the cavity 19. In other embodiments, a portion of the base 17 may be inserted into a hollow portion of the object 200, such as within the hollow interior of a pipe or tubular object 200. In alternative embodiments, the base 17 and/or portions of the skirt 18 may be coupled to an object 200 with one or more fasteners, adhesive, heat bonding, or by integrally forming or molding the object 200 and ground support element 12 together.

In some embodiment, the ground support element 12 may comprise a lead aperture 27 which may extend through the ground support element 12 to allow a lead 20 (FIGS. 3, 4, 7-12) to pass through the cavity 19 base 17, and ground contact surface 28 of the ground support element 12. The lead aperture 27 may extend through the ground support element 12 from the ground contact surface 28 to the cavity 19 to allow a lead 20 to pass through the ground support element 12. In further embodiments, by decreasing the size of the lead aperture 27, the size of an object contact surface 26 may be increased to allow the ground support element 12 to support heavier objects 200. Conversely, by increasing the size of the lead aperture 27, the size of an object contact surface 26 may be decreased to allow the size of the lead 20 to be increased.

As shown in FIGS. 3, 5, 6, in some embodiments, a cavity 19 may be generally cylindrical in shape a configured to receive generally cylindrically shaped poles, posts, and other like objects 200. In other embodiments, the cavity 19 may be generally rectangular prism shaped or triangular prism shaped to receive generally rectangular prism shaped or triangular prism shaped, respectively, poles, posts, and other like objects 200. In some embodiments, the ground contact surface 28 may be generally circular in shape. In further embodiments, it should be understood to one of ordinary skill in the art that a cavity 19, base 17, and/or ground contact surface 28 may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is understood that the terms and proposed shapes used herein are merely descriptive, rather than limiting, and that various changes, such as to size and shape, may be made without departing from the spirit or scope of the invention.

Figure 8:
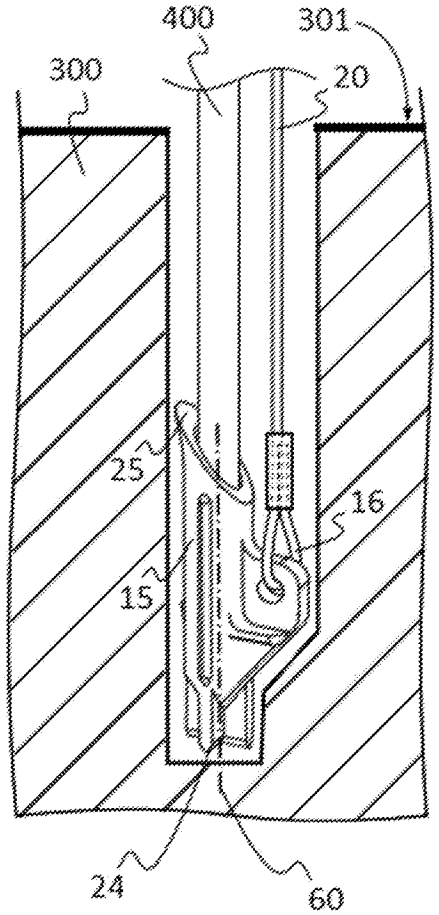
FIG. 8 illustrates an elevation view of an example of a ground anchor being driven into the ground according to various embodiments described herein.

Turning now to FIGS. 7-11, an example of a ground anchor 15 being inserted into the ground 300 is shown. A ground anchor 15 may be inserted or driven into the ground 300 in order to secure the ground anchor 15 within the ground 300 thereby also securing the second end 16 of a lead 20 which is coupled to the ground anchor 15 within the ground 300. In some embodiments, the second end 16 of a lead 20 may be coupled to the ground anchor 15 and a linear driver 400 may be positioned to against the driving end 25, such as within the driving cavity 32 (FIG. 9) of the ground anchor 15. The ground anchor 15 may then be driven into ground 300 by inserting the penetration tip 24 into the surface 301 of the ground 300 as shown in FIG. 7 and by driving the linear driver 400 to drive or more the ground anchor 15 further into the ground 300 to a desired depth in the ground 300 as shown in FIG. 8.

Figure 9:
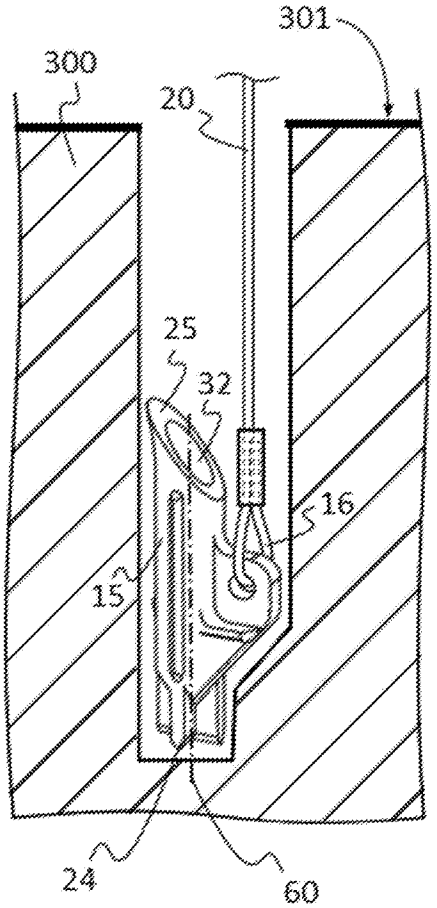
FIG. 9 shows an elevation view of an example of a ground anchor that has been driven into the ground according to various embodiments described herein.
Figure 11:
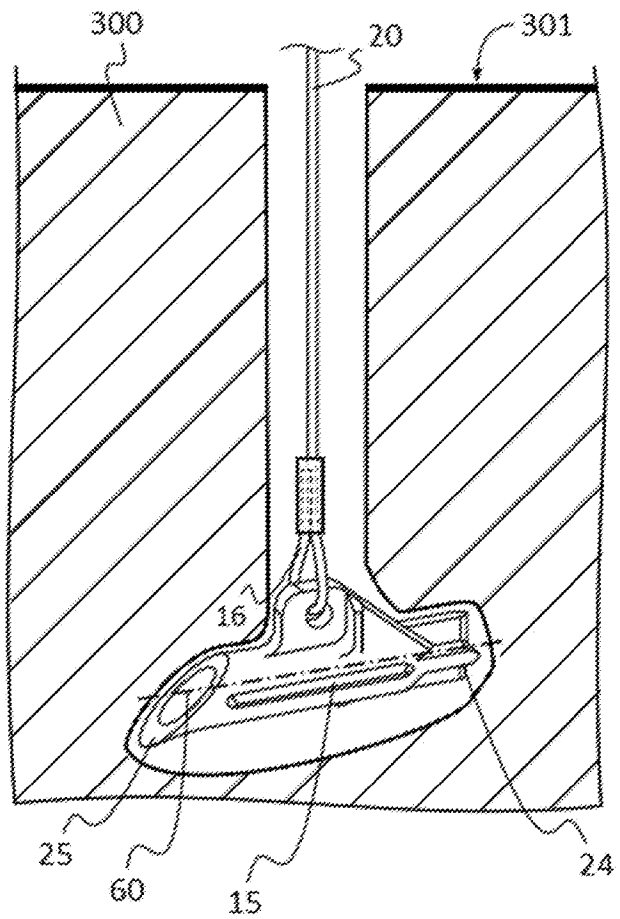
FIG. 11 illustrates an elevation view of an example of a ground anchor that has been driven into the ground with the lead tensioned according to various embodiments described herein.
Figure 10:
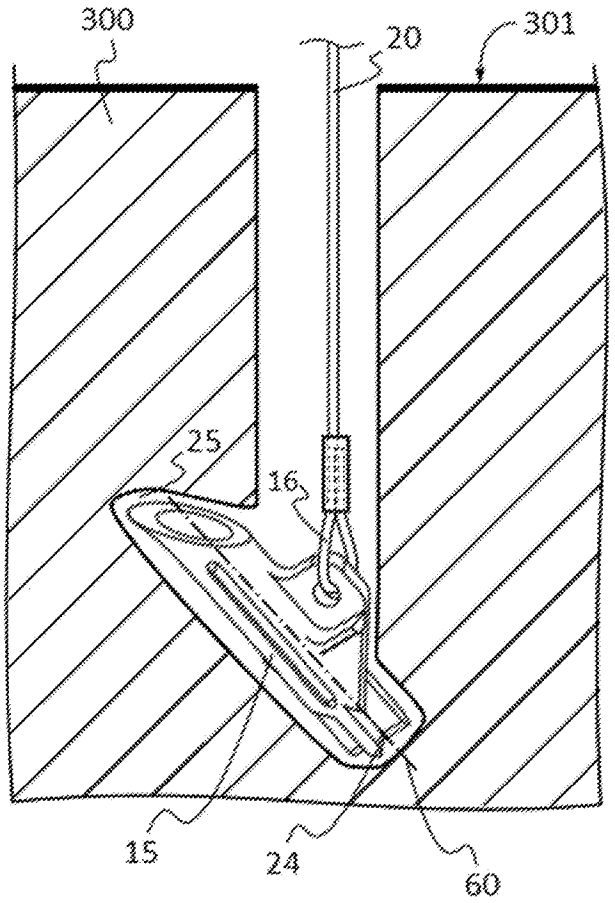
FIG. 10 depicts an elevation view of an example of a ground anchor that has been driven into the ground as the lead is being tensioned according to various embodiments described herein.
Figure 12:
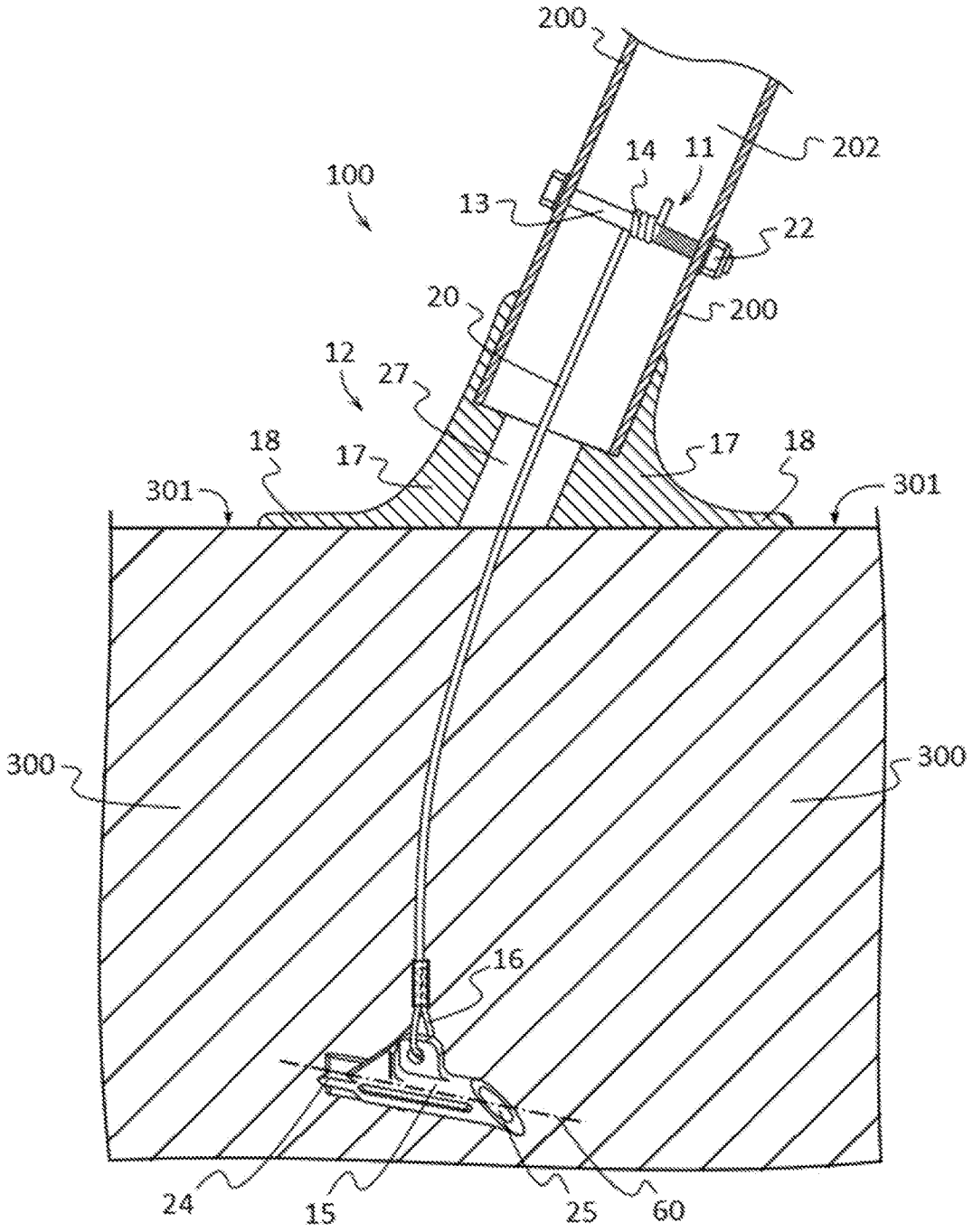
FIG. 12 shows a sectional, through line 12-12 shown in FIG. 2, elevation view of an example of a ground anchoring support apparatus securing an object to a ground surface according to various embodiments described herein.

In some embodiments, the ground anchor 15 may be driven into ground 300 with the lead 20 generally parallel as shown in FIGS. 7-9 to the longitudinal axis 60 of the ground anchor 15. By inserting or driving the ground anchor 15 into ground 300 so that the longitudinal axis 60 is generally parallel to the desired direction of insertion into the ground 300, the resistance of inserting the ground anchor 15 may be reduced. Once the ground anchor 15 is driven to a desired depth in the ground 300 as shown in FIG. 8, the linear driver 400 may be removed from contact with the driving end 25 and also from the ground 300 as shown in FIG. 9. The ground anchor 15 may then be secured within the ground 300 by tensioning the lead 20 so that the second end 16 is drawn towards the first end 14 (FIGS. 3, 4, 12). As the lead 20 is tensioned, the driving end 25 may catch in the ground 300 and the ground anchor 15 may pivot relative to portions of the lead 20 and the ground 300 as shown in FIG. 10. As the tension on the lead is increased, the second end 16 of lead 20 is drawn towards the first end 14 to pivot ground anchor 15 so that the longitudinal axis 60 of the ground anchor 15 may be generally perpendicular to the lead 20, such as generally perpendicular to the first end 14, and/or to the ground surface 301 as shown in FIGS. 11 and 12. The elongate body 30 may resist being retracted or removed from the ground 300 thereby securing the ground anchor 15 within the ground 300.

FIG. 12 depicts a sectional, through line 12-12 shown in FIG. 2, elevation view of an example of a ground anchoring support apparatus 100 securing an object 200 to the surface 301 of the ground 300 according to various embodiments described herein. In some embodiments, once the tension fastener 13 is coupled to the lead 20 and by rotating the tension fastener 13, the lead 20 may be wrapped around the tension fastener 13 thereby drawing or tensioning the second end 16 towards the tension fastener 13. In alternative embodiments, any other type of tensioning fastener 13 which may be secured to the first end 14 of a lead 20 and also to an object 200 and configured to draw or tension the second end 16 towards the tension fastener 13 may be used.

In some embodiments, the first end 14 of the tensioning element 11 may be coupled to the object 200 such as by coupling a tensioning fastener 13 to the object 200. The object 200 may then be coupled to the ground support element 12 such as by inserting a portion of the object 200 into the cavity 19 (FIGS. 1, 3, 4). The tensioning element 11 may comprise a ground anchor 15 coupled to a second end 16 of a lead 20 and a first end 14 which may be coupled to the tensioning fastener 13, such as by inserting a portion of the first end 14 through an aperture on or coupled to the tensioning fastener 13. The lead 20 may be passed through the interior 202 of the object 200 and through the cavity 19, base 17, and ground contact surface 28 by passing the lead 20 through a lead aperture 27 of the ground support element 12. The ground anchor 15 may further comprise a penetration tip 24 and a driving end 25. By inserting the penetration tip 24 into the ground 300 and pressing against the driving end 25, the ground anchor 15 may be driven into the ground as the penetration tip 24 travels through a desired amount or depth of ground 300. When the ground anchor 15 is at the desired depth, an upward pull on the lead 20 may rotate the ground anchor 15 to a parallel position in which the penetration tip 24 and the driving end 25 are orientated generally parallel to the ground surface 301 into which the ground anchor 15 was driven thereby anchoring ground anchor 15 in the ground 300.

Once the ground anchor 15 is anchored into the ground 300 and the ground support element 12 with the received object 200 is positioned proximate, such as over, the ground 300 through which the lead 20 is extending from, the tensioning element 11 may be tensioned. In some embodiments, the tensioning element 11 may be tensioned by rotating the tensioning fastener 13 thereby wrapping the first end 14 of the lead 20 around the tensioning fastener 13 as the tensioning fastener 13 is tensioned. As the first end 14 is wrapped around the tensioning fastener 13, the second end 16 and the first end 14 may be drawn together. In this manner, the ground anchor 15 and tensioning fastener 13 may be drawn or tensioned together to secure the object 200 to the ground support element 12 and also to secure the object 200 to the ground 300 tensioned between the ground anchor 15 and the ground contact surface 28 (FIG. 5).

While some materials have been provided, in other embodiments, the elements that comprise the apparatus 100 such as the tensioning element 11 and ground support element 12 may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A ground anchoring support apparatus for securing an object to the ground, the apparatus comprising:

a lead having a lead first end looped fully around and encircling a tensioning fastener and a lead second end coupled to a ground anchor, the tensioning fastener being rotably coupled to the object and the tension fastener configured to spin within a hollow center interior of the object at a distance above the ground; and wherein the ground anchor is configured to be inserted into the ground and the lead first end is tensioned against the lead second end by rotating the tensioning fastener within the hollow center interior of the object.

2. The ground anchoring support apparatus of claim 1, wherein the lead comprises a flexible material.

3. The ground anchoring support apparatus of claim 1, wherein the lead first end wraps around the tensioning fastener and is configured to further wrap around the tension fastener each time the tensioning fastener is tensioned.

4. The ground anchoring support apparatus of claim 1, further comprising a secondary fastener to rotationally arrest the tensioning fastener relative to the object.

5. The ground anchoring support apparatus of claim 1, further comprising a ground support element having a skirt with a ground contacting surface.

6. The ground anchoring support apparatus of claim 1, wherein the object is angled relative to the ground.

7. The ground anchoring support apparatus of claim 6, wherein the object is angled relative to the ground between 10 and 90 degrees.

8. The ground anchoring support apparatus of claim 1, wherein the apparatus further comprises a ground support element with an object support surface.

9. The ground anchoring support apparatus of claim 8, wherein the ground support element comprises an object stabilizing surface.

10. The ground anchoring support apparatus of claim 8, wherein the ground support element comprises a lead aperture.

11. The ground anchoring support apparatus of claim 1, wherein the ground anchor comprises a body with a longitudinal axis with a penetration tip at a first end of the longitudinal axis and a driving end at a second end of the longitudinal axis.

12. The ground anchoring support apparatus of claim 11, wherein the ground anchor comprises an anchor aperture which is coupled to the second end of the lead.

13. The ground anchoring support apparatus of claim 12, wherein the anchor aperture is coupled to the body at a position generally equidistant to the penetration tip and the driving end.

14. The ground anchoring support apparatus of claim 13, wherein the penetration tip is tapered.

15. The ground anchoring support apparatus of claim 13, wherein the driving end comprises a driving cavity.

16. The ground anchoring support apparatus of claim 13, wherein the ground anchor is configured to be driven into ground by inserting the penetration tip into ground and by driving a linear driver against the driving end.

17. The ground anchoring support apparatus of claim 16, wherein the ground anchor is configured to be driven into ground with the lead generally parallel to the longitudinal axis of the ground anchor.

18. The ground anchoring support apparatus of claim 17, wherein the tensioning of tensioning fastener is configured to draw the second end of lead towards the first end of the lead to pivot the ground anchor so that the longitudinal axis of the ground anchor is generally perpendicular to lead.

* * * * *